US005208572A

United States Patent [19]

Kondo et al.

[11] Patent Number: 5,208,572

[45] Date of Patent: May 4, 1993

[54] AIR-CORE REACTOR WITH A MAGNETIC SHIELD

[75] Inventors: Katsumi Kondo, Akou; Mitsuhiro Kishida, Amagasaki, both of Japan

[73] Assignee: Mitsubishi Denki Kabushiki Kaisha, Tokyo, Japan

[21] Appl. No.: 923,181

[22] Filed: Jul. 8, 1992

[30] Foreign Application Priority Data

Jul. 16, 1991 [JP] Japan ..... 3-175135

[51] Int. Cl.[5] ..... H01F 15/04; H01F 27/30

[52] U.S. Cl. ..... 336/83; 336/84 M; 336/196; 336/234

[58] Field of Search ..... 336/83, 84 R, 84 M, 336/9 L, 196, 198, 212, 217, 234

[56] References Cited

U.S. PATENT DOCUMENTS 3,132,318 5/1964 Kiltie ..... 336/196

*Primary Examiner*—Thomas J. Kozma

*Attorney, Agent, or Firm*—Sughrue, Mion, Zinn, Macpeak & Seas

[57] ABSTRACT

A reactor having a coil surrounded by a magnetic shield formed of laminated magnetic sheets. Connecting members pass through the central opening of the coil and are clamped between sheets of the magnetic shield. Each connecting member comprises a pair of connecting plates having opposite ends expanded. They are inserted from opposite sides of the central opening of the core, and are fixed together. The expanded parts at both ends of the connecting member increases the friction, and reduces vibration and noises.

6 Claims, 7 Drawing Sheets

AIR-CORE REACTOR WITH A MAGNETIC SHIELD

BACKGROUND OF THE INVENTION

The present invention relates to an air-core reactor having a magnetic shield and used for instance in a substation.

FIG. 11 is a perspective view, partially taken away, showing the general configuration of an air-core reactor in the prior art as described in Japanese Patent Kokoku Publication No. S57-39524, for example. FIG. 12 is a plan sectional view of the reactor of FIG. 11. As illustrated, a coil 1 is surrounded by a magnetic shield 2 comprising a plurality of frame-shaped magnetic sheets made of silicon-steel or the like, laminated with each other. Connecting members 3 pass through a central opening 1*a* of coil 1 and are clamped at both ends 3*a* between sheets of the magnetic shield 2. The connecting members 3 comprises a non-magnetic material such as stainless steel, an insulating material or the like.

When an alternating electrical current is applied to the coil 1 of the reactor, electromagnetic forces act on the side walls of the magnetic shield 2 facing the central opening 1*a* of the coil 1, causing vibration and noises. The connecting members 3 strengthens the rigidity of magnetic shield 2, suppressing these vibrations.

The electromagnetic forces acting on the side walls of the magnetic shield 2 facing the central opening 1*a* of the coil 1 increases in proportion to the square of the magnetic flux density. In large reactors, which have a high magnetic flux density, the increase in electromagnetic force is so great that it may overcome the force of friction between the ends 3*a* of the connecting members 3 and the sheets of the magnetic shield 2. Widening the connecting members 3 in order to enlarge their area of contact with the magnetic shield 2 and increase the friction force is not possible since the size of the connecting members 3 is restricted to the width of the central opening 1*a* of the coil 1. Friction at the ends 3*a* of the connecting members which are clamped between sheets of the magnetic shield 2 is thus incapable of fully resisting the strong electromagnetic attraction that occurs with a large alternating electrical current, leading to increase in vibration.

SUMMARY OF THE INVENTION

An object of the present invention is to overcome the problem of the prior art without changing the size of the central opening of the coil by enlarging the area of contact of the connecting members.

A reactor according to the invention comprises:

a coil (1) having a central opening (1*a*);

a magnetic shield (2) having walls surrounding said coil (1) and formed of a plurality of laminated sheets of magnetic material; and a plurality of connecting members (4) inserted through the central opening (1*a*) of said coil and clamped at their first and second ends between sheets of said magnetic shield (2) forming the side walls;

wherein each connecting member (4) is formed of a first and second connecting plates having a front end and a rear end, and a laterally expanded part at the rear end, with the front and rear ends of the first connecting plates being in alignment with the rear and front ends of the second connecting sheets.

DETAILED DESCRIPTION OF THE PREFERRED EMBODIMENTS

A first embodiment of the invention will now be described with reference to FIG. 1A to FIG. 9.

Figure 11:
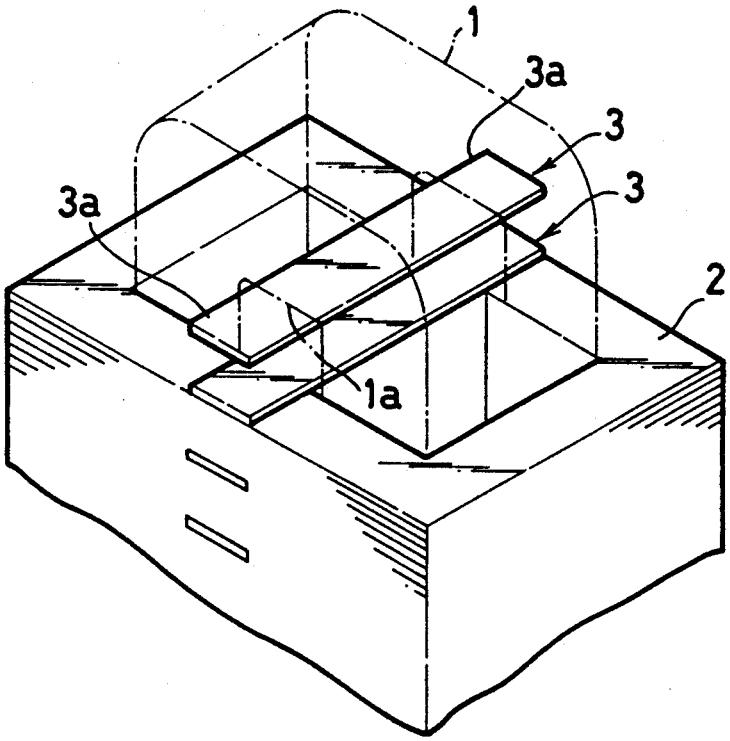
FIG. 11 PRIOR ART
FIG. 11 is a perspective view illustrating the general configuration of a reactor according to the prior art.
Figure 12:
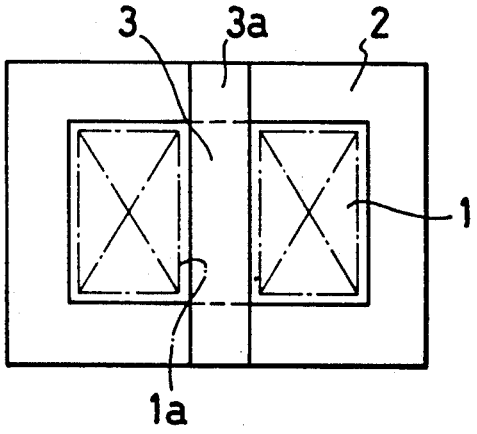
FIG. 12 PRIOR ART
FIG. 12 is a horizontal sectional view of the reactor of FIG. 11.

As illustrated in these drawings, the reactor of this embodiment comprises a coil 1 and a magnetic shield 2, which are similar to those in FIG. 11. More specifically, the magnetic shield 2 is a box-like structure having four side walls 21, 22, 23 and 24, a top wall 25 and a bottom wall 26. The side walls 21, 22, 23 and 24 are formed of generally frame-shaped sheets 27, 28 and 29 (FIG. 8A to FIG. 8C) of a magnetic material which are laminated with each other. The top wall 25 and the bottom wall 26 are each formed of rectangular sheets of a magnetic material laminated with each other, and which are respectively connected at their edges with the uppermost and lowermost ones of the laminated frame-shaped sheets forming the side walls.

Figure 1A:
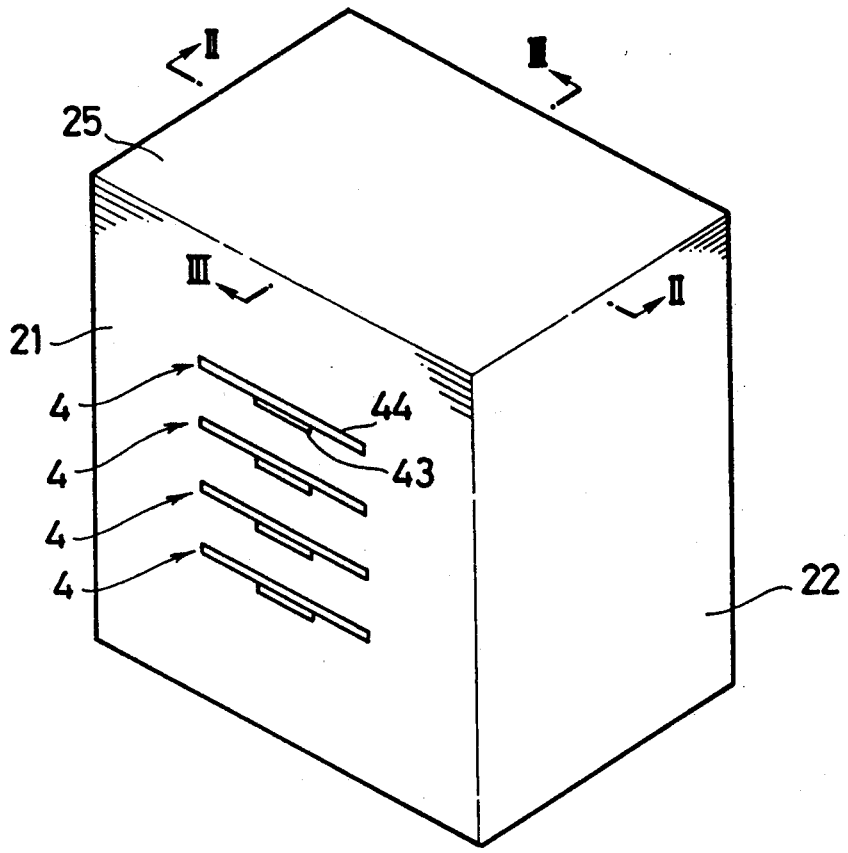
FIG. 1A and FIG. 1B are perspective views, from different angle of views, of an air-core reactor of an embodiment of the invention.
Figure 1B:
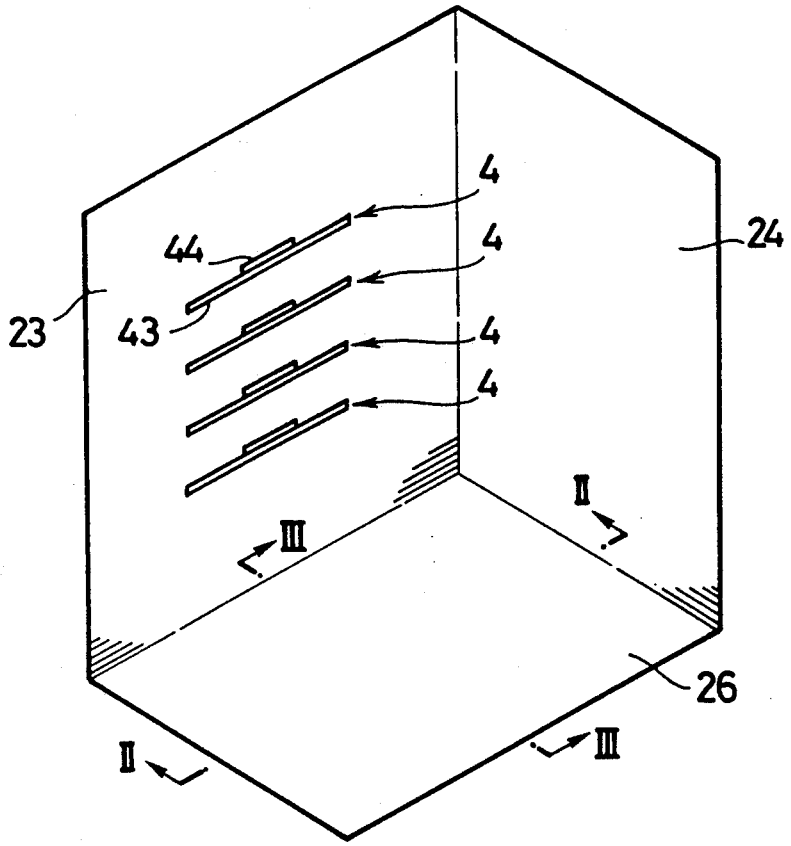
Figure 2:
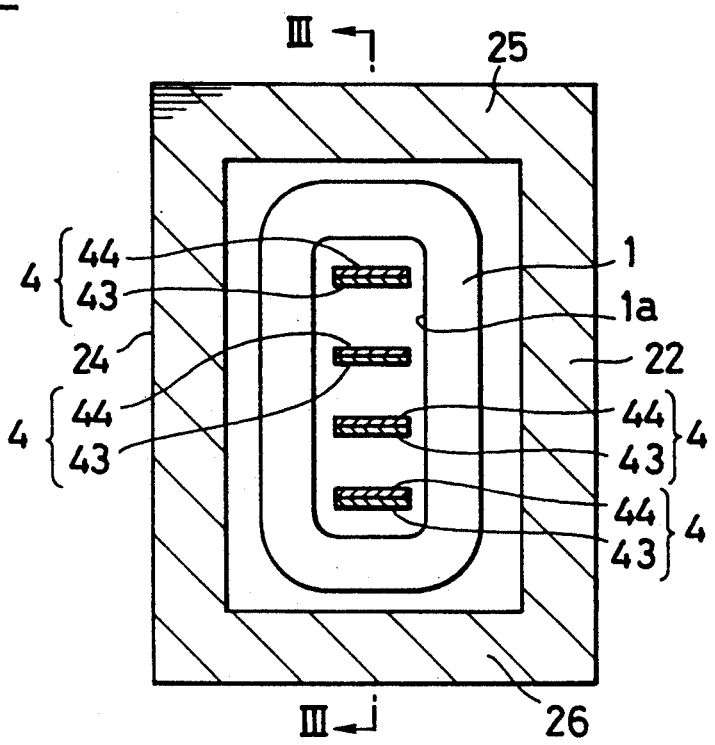
FIG. 2 is an elevational sectional view along line II—II in FIG. 1A and FIG. 1B.
Figure 3:
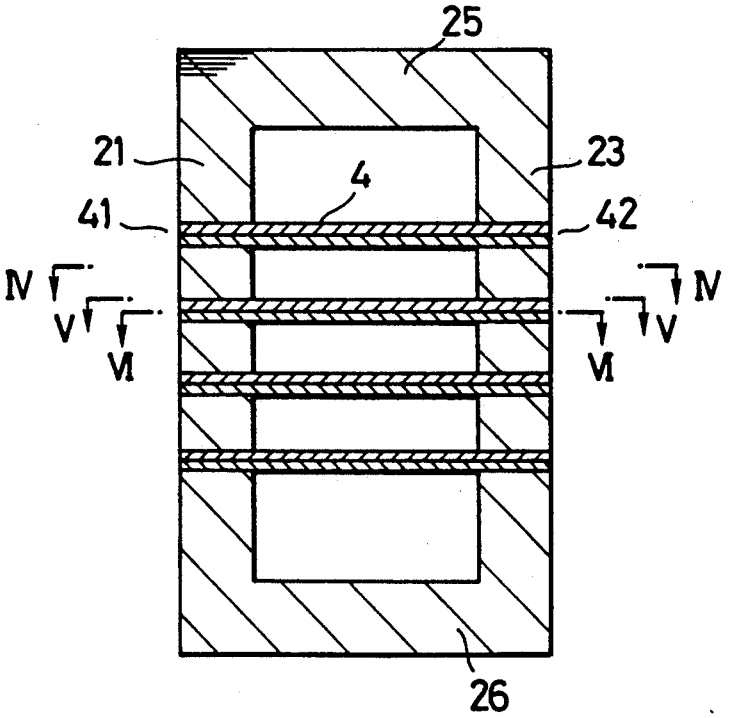
FIG. 3 is a sectional view along line III—III in FIG. 1A, FIG. 1B and FIG. 2.
Figure 4:
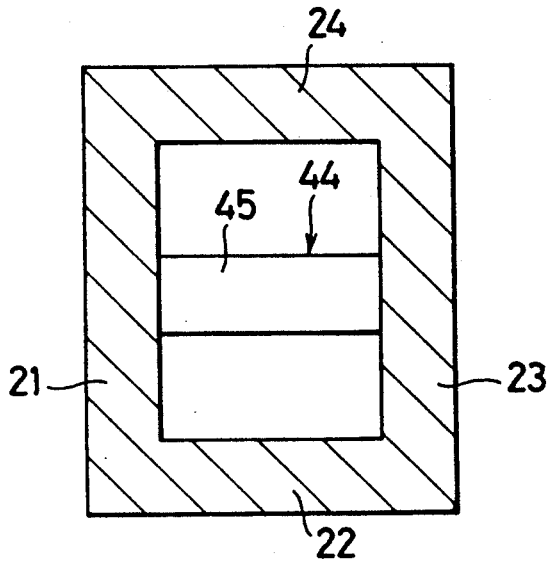
FIG. 4 is a sectional view along line IV—IV in FIG. 3.
Figure 5:
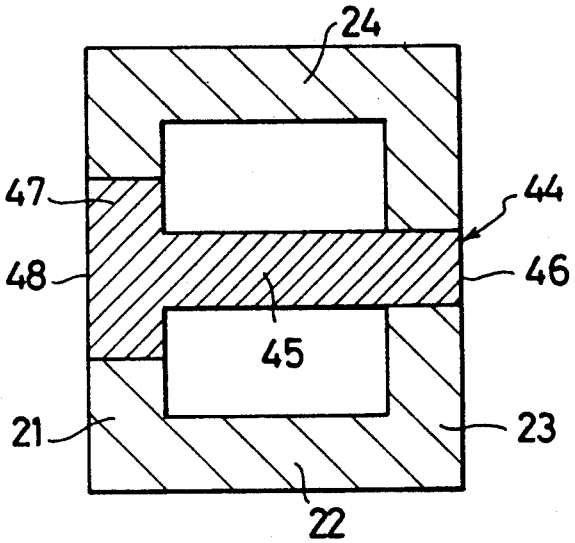
FIG. 5 is a sectional view along line V—V in FIG. 3.
Figure 6:
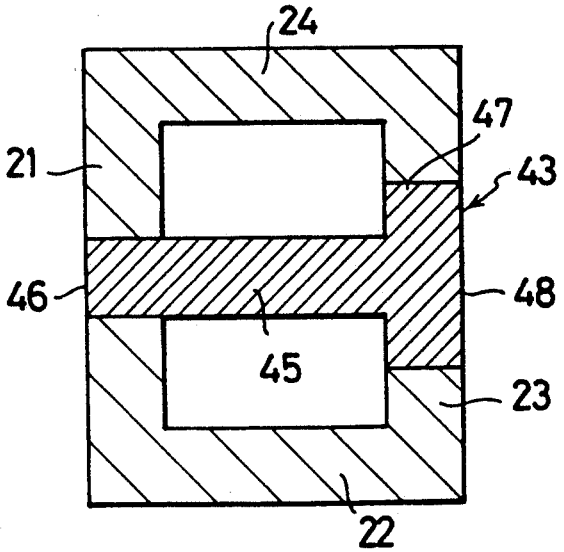
FIG. 6 is a sectional view along line VI—VI in FIG. 3.
Figure 7:
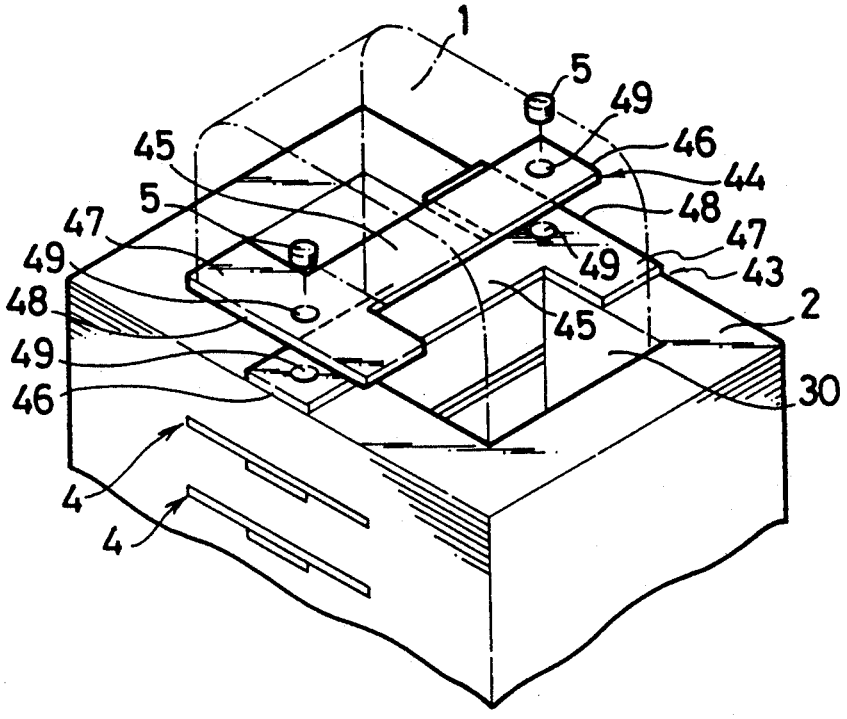
FIG. 7 is a perspective view of a connecting member as assembled in the laminated sheets of the magnetic shield.
Figure 9:
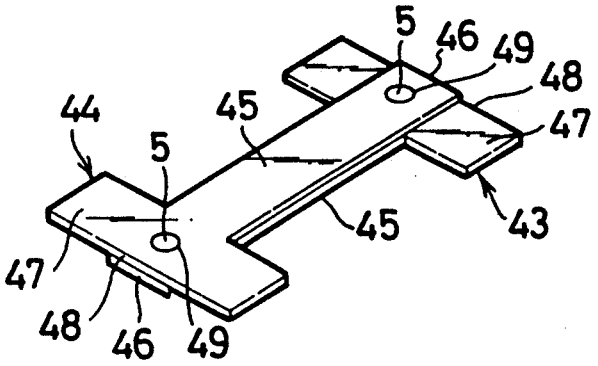
FIG. 9 is a perspective view illustrating the structure of a connecting member in the first embodiment of the present invention.
Figure 8A:
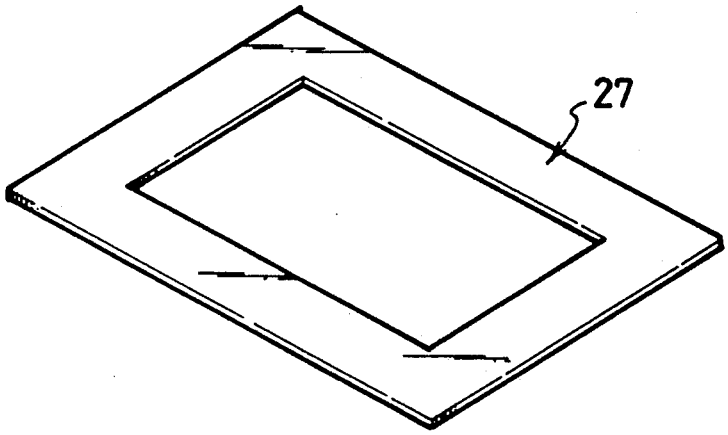
FIG. 8A to FIG. 8C are perspective views of some of the sheets forming the magnetic shield which are laminated in succession.
Figure 8B:
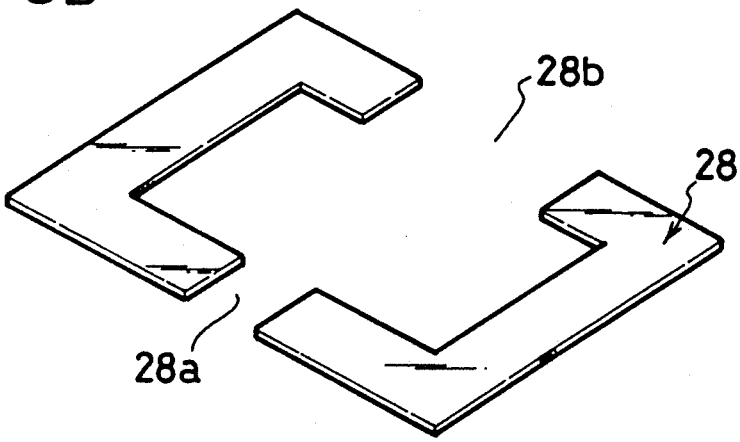
Figure 8C:
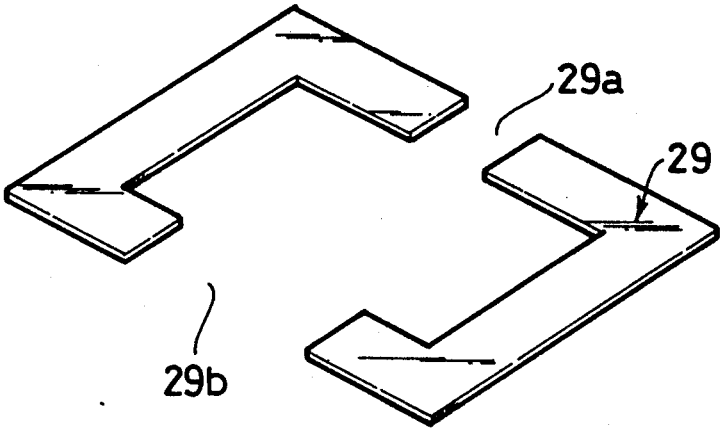

A rectangular space 30 is formed inside the side walls 21 to 24 and the top bottom walls 25 and 26. The coil 1 is disposed in this space 30. As shown in FIG. 2 and FIG. 7, the coil 1 is O-shaped and has a central opening 1*a* which is elongated in the vertical direction. The coil 1 is disposed in the rectangular space 30 so that the opening 1*a* extends in the direction normal to the side walls 21 and 23.

Connecting members 4 extend through the central opening 1*a* of the coil 1, and are supported at their first and second ends 41 and 42 respectively by the opposite side walls 21 and 23. More specifically, the sheets 28 and 29 at the height level where the connecting members 4 are disposed have cutaways 28*a*, 28*b*, 29*a* and 29*b* permitting insertion of the ends of each connecting member 4, as will be more fully described later.

Each of the connecting members 4 comprises a first connecting plate 43 and a second connecting plate 44, each of which has a trunk part 45 extending through the central opening 1*a* of the coil 1 and having a front end 46, and a laterally expanded part, which in the illustrated embodiment is a lateral part 47 extending laterally at a rear end 48 of the trunk part 45, so that the entire connecting sheet is T-shaped.

The first and second connecting plates 43 and 44 are disposed so that their lateral parts 47 are on opposite ends of the connecting member. In the illustrated embodiment, the first connecting plate 43 has the lateral part 47 at the second end 42, and the second connecting plate 44 has the lateral part 47 at the first end 41, and the second connecting plate 44 is placed on top of the first connecting plate 43. Pins 5 are inserted through holes 49 at the ends of the connecting plates 43 and 44 to prevent the two connecting plates 43 and 44 from sliding with respect to each other.

Each sheet forming the magnetic shield 2 is about 0.3 mm thick, for instance.

The thickness of each T-shaped connecting plate is 3 to 9 mm thick, for instance, and corresponds to the thickness of a certain number, N, of magnetic sheets laminated with each other. N magnetic sheets consecutive to each other and at the height level of the first connecting member 43 are of the type 28 shown in FIG. 8B. The cutaways 28*a* and 28*b* of the N consecutive laminated sheets 28 form slots which permit insertion of the ends 46 and 48 of the first connecting plate 43. N magnetic sheets consecutive to each other and at the height level of the second connecting member 44 are of the type 29 shown in FIG. 8C. The cutaways 29*a* and 29*b* of the N consecutive laminated sheets 29 form slots which permit insertion of the ends 46 and 48 of the second connecting plate 44. The magnetic sheets at other height levels are of the type 27 shown in FIG. 8A. Accordingly, the ends of the connecting plates 43 and 44 are inserted in the cutaways 28*a*, 28*b*, 29*a* or 29*b* of the sheets 28 or 29, and are clamped by the sheets 27 immediately above or below the sheets 28 or 29.

The connecting members 4 are provided at suitable intervals in the vertical direction.

The sheets are compressed, by means not shown, in the vertical direction in which they are laminated, so that the ends 41 and 42 of the connecting members 4 are in pressure contact with the sheets.

The connecting plates 43 and 44 may be inserted as the magnetic sheets 27 to 29 are laminated or stacked to form the box like structure. In such a case, after the bottom wall 26 is formed, the coil 1 is placed on the bottom wall 26 in position, the sheets 27 are stacked, each sheets surrounding the coil 1, up to the height level where a first, or lowermost connecting member 4 is disposed. Then, N sheets 28 are stacked. Then, a first plate 43 is inserted from the side of the side wall 23 through the central opening 1*a*, with its front end 46 being at the head as the first plate 43 is inserted. When the front end 46 reaches the first side wall 21, the front and rear ends 46 and 48 of the first plate 43 are positioned at the cutaways 28*a* and 28*b* in the sheets 28. For the insertion, the first plate 43 may be moved horizontally above the sheets 29 till the front and rear ends 46 and 48 are aligned with the cutaways 28*a* and 28*b*, and then lowered so that the front and rear ends 46 and 48 are placed in the cutaways 28*a* and 28*b* (i.e., the slots formed thereby). Alternatively, the first plate 43 may be moved at the same height level as the sheets 28, through the cutaways 28*b* of the sheets 28 in the side wall 23, and then through the central opening 1*a* of the coil 1, until the front end 46 reaches the cutaways 28*a* in the sheets 28 in the first side wall 21. In this case, no lowering action is required.

Then, another N sheets 29 are stacked. Then, a second connecting plate 44 is placed, with its ends 46 and 48 inserted into the cutaways 29*a* and 29*b* (i.e., the slots formed thereby). The second connecting plate 44 is inserted from the side of the side wall 21, with its front end 46 being at the head as the second plate 44 is moved horizontally through the central opening 1*a* of the coil 1. Thus, the second plate 44 is inserted from the side opposite to the side from which the first plate 43 was inserted.

The second plate 44 is placed on the first plate 43, with its front and rear ends 46 and 48 on the rear and front ends 48 and 46 of the first plate 43.

After the first and the second plates 43 and 44 are placed in position, pins 5 are inserted through the holes 49*a* at the ends of the first and second plates 43 and 44.

Then, the sheets 27 are stacked up to the position where the next connecting member 4 is disposed. The above process is repeated until all the connecting members are placed. After the last (uppermost) connecting member 4 is placed, the sheets 27 are stacked up to the upper end of the side walls. Then the top wall 25 is formed by placing the rectangular sheets in stack. Thus, the magnetic shield is completed.

An advantage of the use of the above described connecting members 4 is that the friction between the ends of the connecting members 4 and the sheets of the sidewalls of the magnetic shield is increased due to the laterally expanded parts, e.g., the lateral part 47, at both ends of each connecting member 4. The increased friction provides the magnetic shield 2 with an increased rigidity, and hence reduces vibration and noises.

In the embodiment described above, the first and second connecting plates 43 and 44 are fixed with each other by means of pins 5. As an alternative, the connecting plates 43 and 44 may be fixed by means of an adhesive agent. An example of such an adhesive is epoxy cement.

Figure 10:
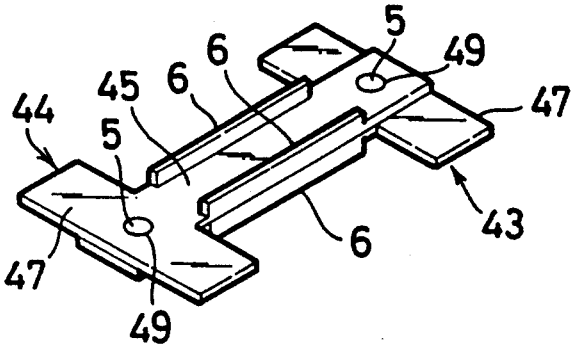
FIG. 10 is a perspective view illustrating the structure of a connecting member in another embodiment of the present invention.

FIG. 10 is a perspective view of a pair of connecting plates forming the connecting member 4, in another embodiment of the invention. The connecting member 4 of this embodiment is identical to the connecting member 4 of the embodiment of FIG. 1A to FIG. 9, but the trunk part is provided with ridges 6 along both edges so that the cross section of the trunk part 45 is channel-shaped. The ridges 6 extend over parts of the trunk which are positioned within the space 30, and are not clamped by the sheets of the magnetic shield 2 in the side walls 21 and 23. The ridges 6 of the first connecting plate 43 extends downward, while the ridges 6 of the second connecting plate 43 extend upward, so that they do not interfere with each other. Because of the ridges, the strength of the trunk part against compressive stress in the longitudinal direction of the trunk part, i.e., the strength against buckling, is improved.

In place of the channel-shaped cross section, the trunk part may have a T-shaped cross section (with a ridge along the widthwise center), or a semi-circular cross section, or a cross section of any other shape having a greater geometrical moment of inertia.

As has been described, according to the invention, the area of contact between both ends of the connecting member and the magnetic sheets of the magnetic shield is increased, so that the friction is enlarged, and the vibration and noises are reduced. Moreover, by adopting the cross section having a larger geometrical moment of inertia, the strength against buckling is increased so that the vibration and noises are further reduced.

What is claimed is:

1. A reactor comprising:

a coil (1) having a central opening (1*a*);

a magnetic shield (2) having walls surrounding said coil (1) and formed of a plurality of laminated sheets of magnetic material; and a plurality of connecting members (4) inserted through the central opening (1*a*) of said coil and clamped at their first and second ends between the sheets of said magnetic shield (2) forming the side walls;

wherein each connecting member (4) is formed of a first and second connecting plates having a front end and a rear end, and a laterally expanded part at the rear end, with the front and rear ends of the first connecting plates being in alignment with the rear and front ends of the second connecting sheets.

2. The reactor of claim 1, wherein said first and second connecting plates are fixed together by means of pins extending through holes provided at the front and rear ends of the first and second connecting plates.

3. The reactor of claim 1, wherein said first and second connecting plates are fixed together by means of an adhesive.

4. The reactor of claim 1, wherein said connecting plates have ridges along their edges.

5. The reactor of claim 1, wherein the sheets at the height level where the connection member is disposed have cutaways in which the ends of the connecting member are accommodated, and the ends of the connecting members are in contact with the sheets without cutaways adjacent the sheets having cutaways.

6. The reactor of claim 1, wherein the sheets are compressed in the direction in which they are laminated, so that the ends of the connecting members are in pressure contact with the sheets.

* * * * *